US007837493B2

(12) United States Patent
Noh

(10) Patent No.: US 7,837,493 B2
(45) Date of Patent: Nov. 23, 2010

(54) LAMP SOCKET AND LIGHT APPLIANCE THEREOF

(75) Inventor: Si Chung Noh, 624-8, Seogu-ri, Gwangjeok-myeon, Yangju-si, Gyeonggi-do (KR)

(73) Assignee: Si Chung Noh (KR)

( * ) Notice: Subject to any disclaimer, the term of this patent is extended or adjusted under 35 U.S.C. 154(b) by 52 days.

(21) Appl. No.: 12/307,251

(22) PCT Filed: Jul. 5, 2007

(86) PCT No.: PCT/KR2007/003270

§ 371 (c)(1),
(2), (4) Date: Dec. 31, 2008

(87) PCT Pub. No.: WO2008/004825

PCT Pub. Date: Jan. 10, 2008

(65) Prior Publication Data

US 2009/0239407 A1 Sep. 24, 2009

(30) Foreign Application Priority Data

Jul. 5, 2006 (KR) ..... 20-2006-0018210 U
Jul. 18, 2006 (KR) ..... 20-2006-0019298 U

(51) Int. Cl.
*H01R 13/64* (2006.01)

(52) U.S. Cl. ..... 439/375; 439/226; 362/221

(58) Field of Classification Search ..... None
See application file for complete search history.

(56) References Cited

U.S. PATENT DOCUMENTS

| | | | | |
|---|---|---|---|---|
| 4,803,600 | A * | 2/1989 | Pepping | 362/217.16 |
| 5,381,321 | A * | 1/1995 | Fearing et al. | 362/223 |
| 5,904,415 | A * | 5/1999 | Robertson et al. | 362/260 |
| 6,039,460 | A | 3/2000 | Ng et al. | |
| 2007/0183149 | A1 * | 8/2007 | Ko et al. | 362/225 |

FOREIGN PATENT DOCUMENTS

| | | | |
|---|---|---|---|
| CN | 1362592 | A | 8/2002 |
| JP | 07-335007 | A | 12/1995 |
| JP | 18-049042 | A | 2/2006 |

OTHER PUBLICATIONS

International Search Report for International Application No. PCT/KR2007/003270, dated Oct. 24, 2007.

* cited by examiner

*Primary Examiner*—Michael C Zarroli
(74) *Attorney, Agent, or Firm*—Finnegan, Henderson, Farabow, Garrett & Dunner, LLP

(57) ABSTRACT

A lamp socket includes connection terminal bodies including connection terminals provided in sides of the lamp socket to contact with connection pins of the lamp, and connection terminal recesses into which the connection terminals are inserted, and connection caps to slide to press and fix the connection pins when the connection pins contact with the connection terminals.

8 Claims, 7 Drawing Sheets

LAMP SOCKET AND LIGHT APPLIANCE THEREOF

This application claims priority to PCT International Application No. PCT/KR2007/003270 filed on Jul. 5, 2007, now International Publication No. WO 2008/004825 A1, which claims the benefit of Korean Patent Application No. 20-2006-0018210 filed on Jul. 5, 2006, and Korean Patent Application No. 20-2006-0019298 filed on Jul. 18, 2006, all of which are incorporated herein by reference.

TECHNICAL FIELD

The present invention relates to a lamp socket and a light appliance thereof, and more particularly, to a lamp socket in which a lamp is mounted and separated to and from a light appliance by sliding a connection cap of the lamp socket when the lamp is placed in the light appliance without rotation and pressure with respect to the light appliance so that the lamp is easily and conveniently mounted and separated to and from the light appliance, and a light appliance having the lamp socket.

BACKGROUND ART

Generally, light appliances in which fluorescent lamps are installed are grouped into a ballast built-in type light appliance installed with ballast and a ballast separation type light appliance without ballast.

Moreover, the light appliances are grouped into an integrated type light appliance in which the fluorescent lamp is integrally formed and a separated type light appliance in which the fluorescent lamp is installed and separated to and from the light appliance.

In a ballast built-in and separated type light appliance, a technology for preventing a fluorescent lamp from being separated from the light appliance is disclosed in Korean Unexamined Patent Application Publication No. 2004-32619, filed on May 10, 2004, by this applicant.

According to aspects of the conventional light appliance for a fluorescent lamp disclosed in Korean Unexamined Patent Application Publication No. 2004-32619, when terminal pins of a fluorescent lamp enter supporting holes along entrance holes, the terminal pins elastically contact connection terminal such that ballast is electrically connected to the fluorescent lamp. Thus, electric power can be supplied from the ballast to the fluorescent lamp.

Moreover, since the terminal pins of the fluorescent lamp are stably placed in the lower ends of the supporting holes and their rotations are prevented by lockers formed in the lower ends of the supporting holes, the fluorescent lamp is prevented from being separated from a socket installed in the light appliance.

However, in the conventional light appliance for a fluorescent lamp, when the fluorescent lamp is installed and separated to and from the socket of the light appliance, the fluorescent lamp is broken when the fluorescent lamp is pressed during the contact and separation of the connection pins of the fluorescent lamp to and from the connection terminal formed in the socket of the light appliance.

Moreover, when elastic force of the connection terminals installed in the socket of the light appliance is inferior, the fluorescent lamp that is coupled with the socket of the light appliance is separated from the socket and is broken.

DISCLOSURE

Technical Problem

Therefore, the present invention has been made in view of the above problems, and it is an aspect of the present invention to provide a lamp socket in which, when a lamp is placed in a light appliance by connection caps of a socket that are provided to slide at lateral ends of the light appliance, the lamp is fixed and connected to the socket and the connection is released by the slide of the connection caps so that pressure against the lamp during the installation and the separation of the lamp is excluded to prevent the lamp from being broken during the installation and the separation of the lamp, and a light appliance having the lamp socket.

It is another aspect of the present invention to provide a lamp socket in which a lamp is placed in a light appliance to be fixed and connected and released to and from a socket by connection caps of the socket that are provided to slide at lateral ends of the light appliance so that installation of the lamp coupled with the socket of the light appliance can be improved, and a light appliance having the lamp socket.

Technical Solution

In accordance with an aspect of the present invention, the above and other objects can be accomplished by the provision of a lamp socket provided in a light appliance to fix a lamp with connection pins comprising: connection terminal bodies including connection terminals provided in sides of the lamp socket to contact the connection pins of the lamp and connection terminal recesses into which the connection terminals are inserted; and connection caps for sliding to press and fix the connection pins when the connection pins contact the connection terminals.

Moreover, the connection terminal bodies comprise guide recesses, formed at lateral sides of the connection terminal bodies, along which the connection caps slide, and the connection caps comprise guide protrusions inserted into the guide recesses.

Preferably, the connection caps comprise connection protrusions protruded from inner sides of the connection caps such that the connection protrusions press the connection pins to increase contacting force against the connection terminals when the connection caps slide.

The lamp socket further comprises safety protrusions protruded from sides of the connection caps to prevent an electric shock due to the connection pins when the connection pins of the lamp are coupled in the connection terminal recesses and safety engaging recesses formed in the central regions of the connection caps to allow the connection pins to penetrate therethrough.

Preferably, an elastic member is installed in the connection terminal recesses and the connection terminals are inserted into the upper sides of the elastic member so that the contacting force between the connection terminals and the connection pins is increased when the connection caps slide.

The lamp socket further comprises supporting protrusions protruded from sides of the connection terminal bodies to support the lamp when the connection terminals contact the connection pins.

Moreover, each of the connection terminal bodies further comprises: an insertion unit having a side with a cross section corresponding to the hollow housing to be inserted into the housing; and a locking unit protruded over the insertion unit to be locked by the housing due to the insertion of the insertion unit; insides of the insertion unit and the locking unit are hollow such that electric wires for electrical connection of the connection terminals pass therethrough.

In accordance with another aspect of the present invention, the above and other objects can be accomplished by the provision of a light appliance to which a lamp is installed, comprising: a housing as a case in which an electronic ballast and electronic components to drive the lamp are installed; and the lamp socket according to any one of claims 1 to 6 connected to the housing.

Preferably, the connection terminals of the lamp socket inwardly face each other or are outwardly spaced apart from each other corresponding to a direction where the lamp socket is coupled with the connection pins.

Advantageous Effects

As described above, according to the lamp socket of the present invention and a light appliance having the same, since the lamp is fixed and connected to the socket and the connection is released by the slide of the connection caps when the lamp is placed in the light appliance by the connection caps of the socket that are provided to slide at lateral ends of the light appliance, the lamp can be conveniently installed without applying pressure to the lamp and the lamp can be prevented from being broken during the installation and the separation of the lamp.

Moreover, according to the lamp socket of the present invention and a light appliance having the same, since the lamp is placed in the light appliance to be fixed and connected and released to and from the socket by the connection caps of the socket that are provided to slide at lateral ends of the light appliance and the lamp is installed and separated to and from the light appliance due to the slide of the connection caps, the installation and separation of the lamp can be promptly carried out in convenient and easy fashion.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

BEST MODE

Figure 1:
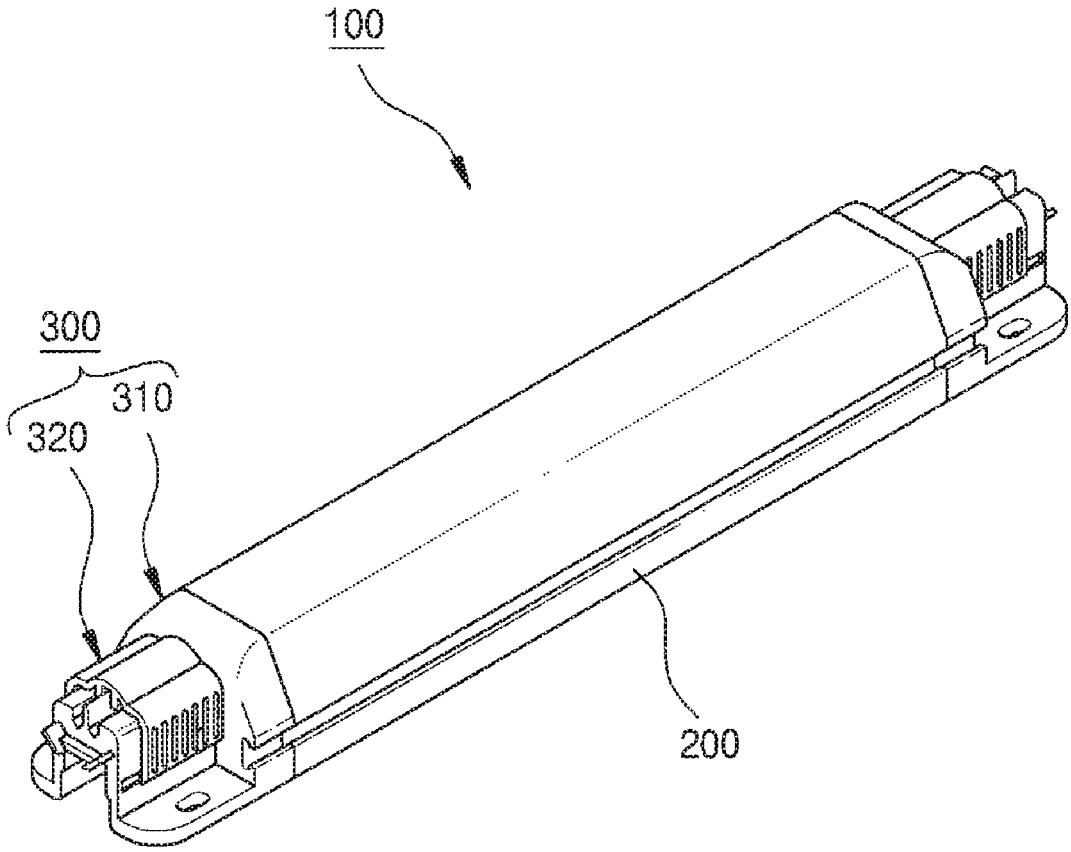
FIG. 1 is a perspective view illustrating a lamp socket according to an embodiment of the present invention and a light appliance having the same.
Figure 2:
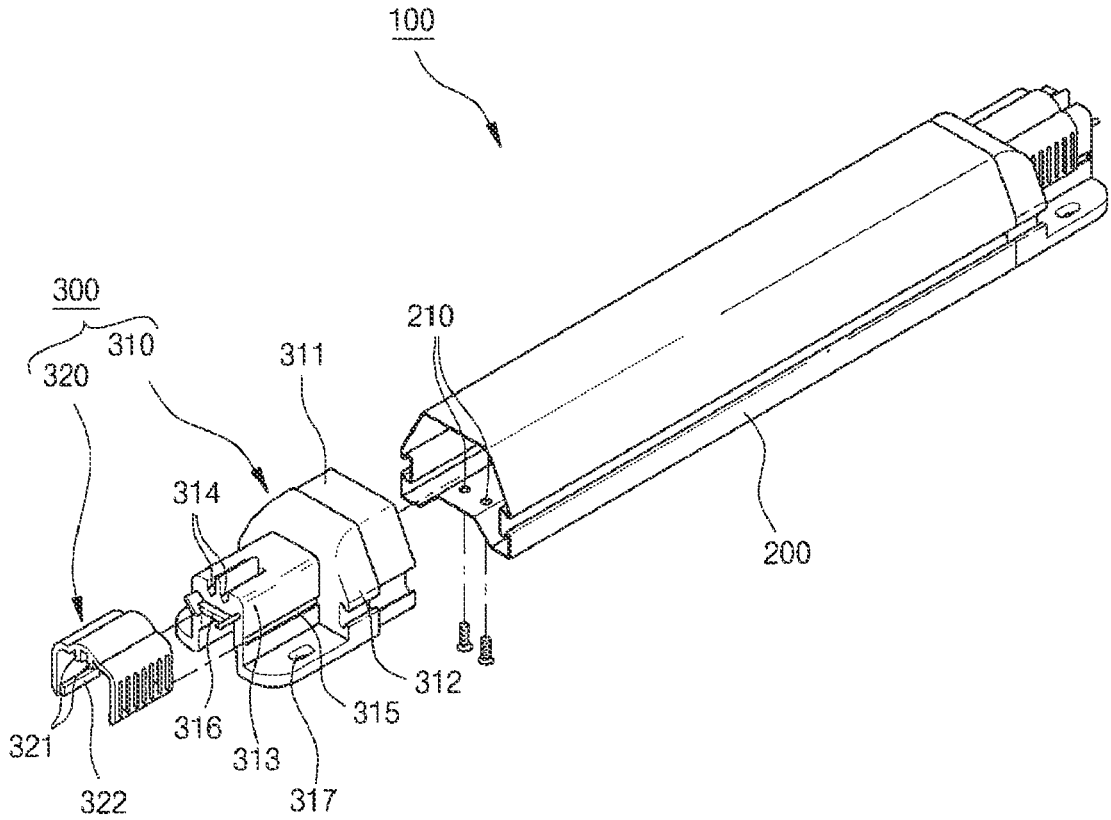
FIG. 2 is a partially exploded perspective view illustrating the lamp socket according to the embodiment of the present invention and a lamp socket of the light appliance having the same.

Hereinafter, the embodiments of the present invention will be described in detail with reference to the accompanying drawings.

Firstly, in the drawing, it should be noticed that same reference numerals are assigned to same components and parts. In the following description of the present invention, if the detailed description of the already known structure and operation may confuse the subject matter of the present invention, the detailed description thereof will be omitted.

Next, preferred embodiment of the present invention having the above-mentioned basic concept for the lamp socket and the light appliance having the same will be described in detail with reference to the accompanying drawings.

FIGS. 1 to 5 illustrate a lamp socket according to an embodiment of the present invention and a light appliance having the same.

As illustrated in the drawings, a lamp socket 300 according to an embodiment of the present invention is configured such that a side of the lamp socket 300 is inserted into and fixed to a hollow cylinder housing 200 in which connection terminals 20 connected to connection pins 11 of a lamp 10 (See FIG. 5) and a substrate (not shown) having ballast and various electric wires are installed on an inner bottom of the housing 200 so that the lamp socket 300 is electrically connected and separated to and from the connection pins 11 when the connection pins 11 are pressed and released.

The lamp 10 includes several parallel main tubes 12, two auxiliary tubes 13 having the connection pins 11, and several connection tubes 14 to vertically connect the main tubes 12 to the auxiliary tubes to seal the lamp 10.

The ballast is an electronic type, it includes electric components such as a resistor, a capacitor, a transformer, and the like, which are mounted in the substrate, and controls lightning on and off of the lamp 10.

Moreover, the electronic ballast may be electrically connected to a controller to regulate illuminance and color temperature of the lamp 10.

Hereinafter, the lamp socket 300 according to the embodiment of the present invention will be described in detail.

The socket 300 includes a connection terminal body 310 having an end inserted into the housing 200, and a connection cap 320 coupled with the connection terminal body 310 to slide thereon and to cover the upper side and lateral sides of the connection terminal body 310.

The connection terminal body 310 is made in the form of a single body such that a part of the connection terminal body 310 is inserted into and is connected to the housing 200.

In other words, the connection terminal body 310 includes an insertion unit 311 having a side with a cross section corresponding to the hollow housing 200 to be inserted into the housing 200 and a coupling hole (not shown) formed in the lower side to be fixed to the housing 200 by a screw, a locking unit 312 protruded over the insertion unit 311 to be locked by the housing 200 due to the insertion of the insertion unit 311, and a connection unit having connection terminal recesses 314 spaced apart from each other on the upper side to be connected to the connection pins 11 when the lamp 10 is installed to other side of the locking unit 312.

Figure 3:
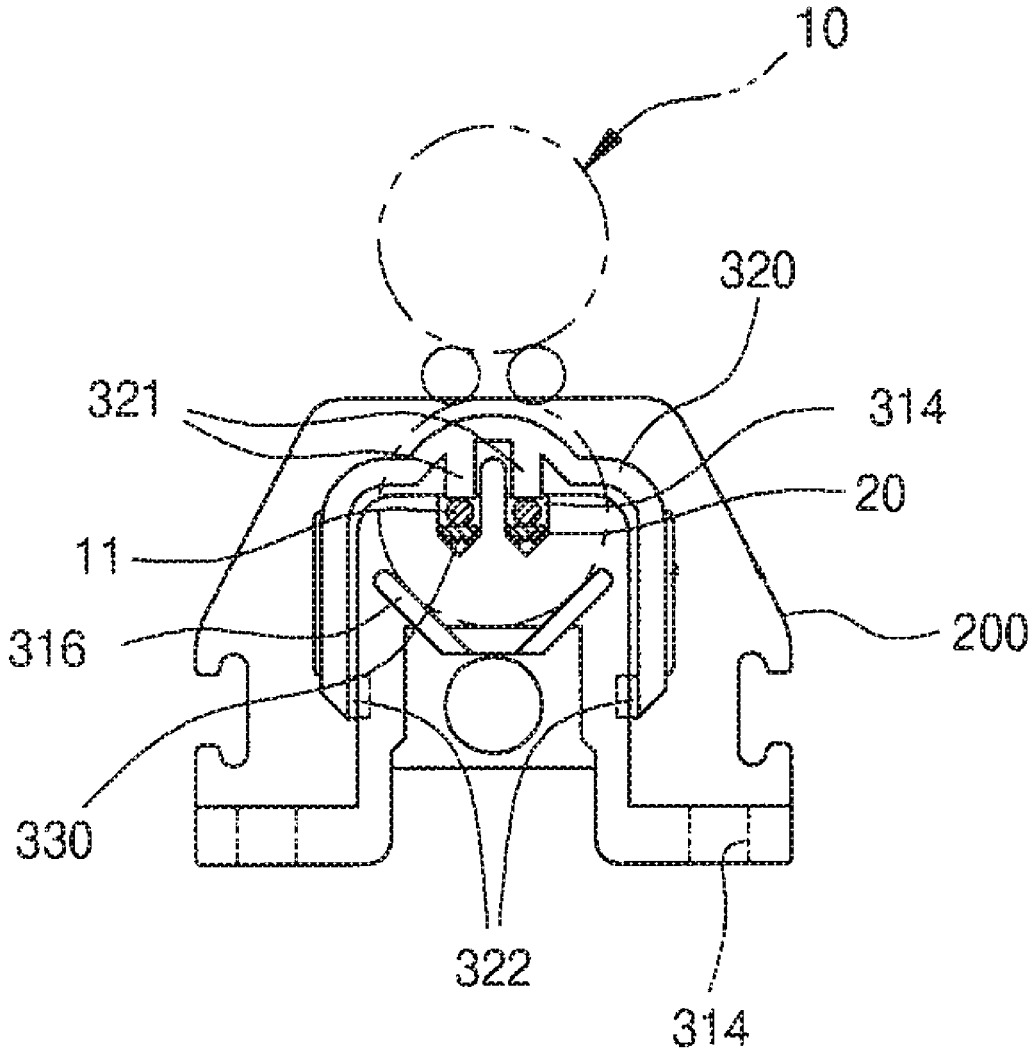
FIG. 3 is a side view illustrating the lamp socket according to the embodiment of the present invention and a lamp socket of the light appliance having the same.

On the bottoms of the connection terminal recesses 314, as illustrated in FIG. 3, when the connection caps 320 slide for the installation of the lamp 10, elastic members 330 are installed to increase contacting force against the connection pins 11 by providing elastic force to the connection terminals 20.

The elastic members 330 are implemented by one selected from coil springs and plate springs.

Moreover, insides of the insertion unit 311 and the locking unit 312 are hollow such that electric wires for electrical connection of the connection terminals 20 pass therethrough.

The lateral sides of the connection unit 313 are formed with guide recesses 315 to slide and insert both ends of the connection cap 320 into the connection unit 313.

Respective outer sides of the connection terminal body 310 of the socket 300 have outwardly protruded supporting protrusions 316 to steadily support both ends of the lamp 10 such that the lamp 10 is prevented from vibrating when the lamp 10 is installed.

Moreover, installation holes 317 penetrate lateral bottoms of the connection terminal body 310 to fix a light appliance 100 on the ceiling or a wall.

The connection cap 320 of the socket 300 is provided to the connection unit 313 of the connection terminal body 310 to slide so that the lamp 10 can be easily installed and separated to and from the light appliance 100.

In other words, the connection cap 320 has an approximate reversed "U"-shaped cross section to cover the upper side and lateral sides of the connection terminal body 310 and guide protrusions 322 to slide along the guide recesses 315, and connection protrusions 321 formed on the inner bottom to lock and release the connection pins 11 when the lamp 10 is installed to the connection terminals 20 provided in the connection terminal recesses 314.

Figure 4:
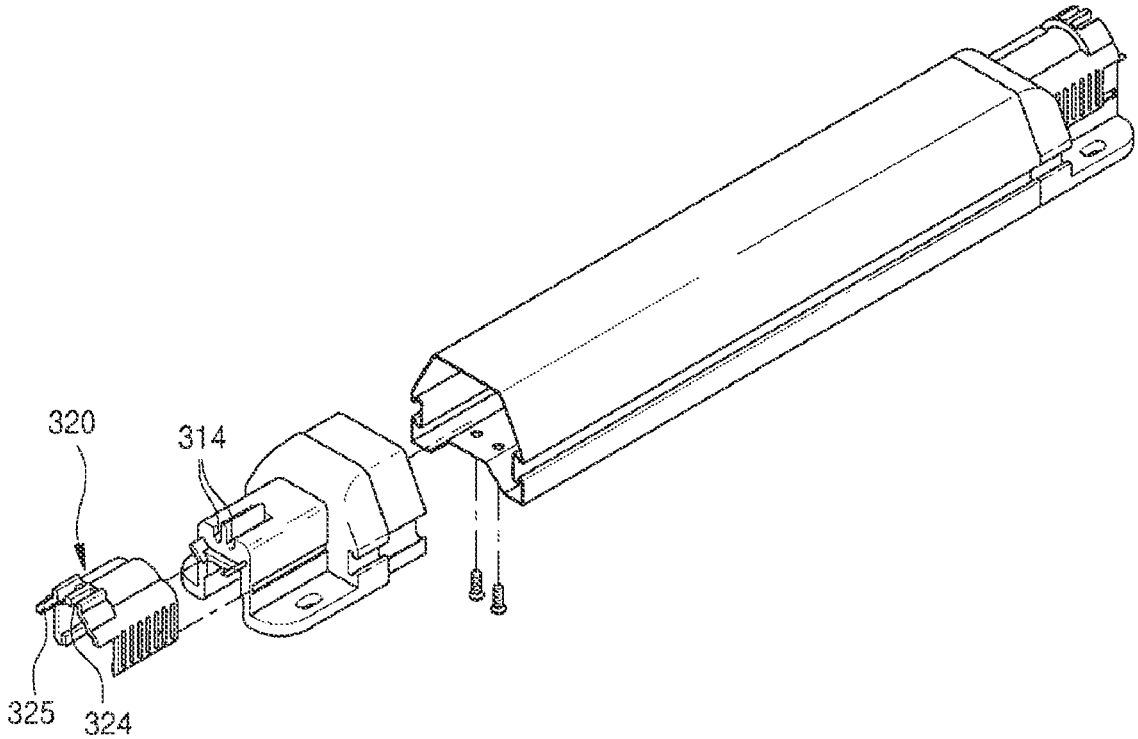
FIG. 4 is a partially exploded perspective view illustrating a lamp socket according to another embodiment of the present invention and a light appliance having the same in a state when a socket is exploded.
Figure 5:
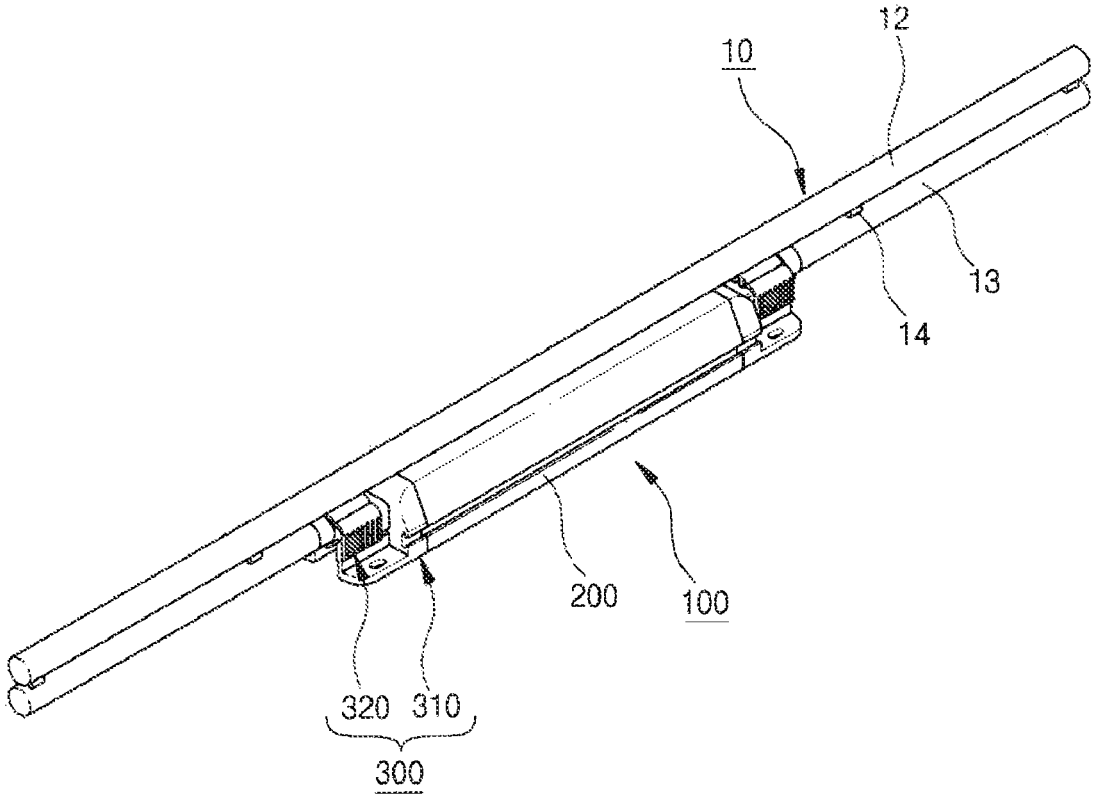
FIG. 5 is a perspective view illustrating a lamp installed to the light appliance having the lamp socket according to another embodiment of the present invention.

On the other hand, as illustrated in FIG. 4, a safety protrusion 325 is protruded from a side of the connection cap 320 to prevent an electric shock due to the connection pins 11 when the connection pins 11 of the lamp 10 are coupled in the connection terminal recesses 314 and has safety engaging recess 324 formed in the central region of the connection cap 320 to allow the connection pins 11 to penetrate.

Slide prevention protrusions 324 are protruded from outer lateral sides of the connection cap 320 to prevent the connection cap 320 from slipping when the connection cap 320 slides.

Hereinafter, configuration of the light appliance having the lamp socket according to the embodiment of the present invention will be described.

The light appliance 100 includes the socket 300, and the single body hollow housing 200 to insert and fix an end of the socket 300 to both ends of the housing 200.

In other words, the housing 200 is formed in the form of a hollow cylinder such that the connection terminals 20 to connect a power cord for supplying electric power to the connection pins of the lamp 10 and the ballast can be installed without exposure, and has fixing holes 210 formed in both ends of a bottom to fix the housing 200 to the connection terminal body 310 of the socket 300 by screws.

Although the housing 200 is implemented by the single hollow body, it is not limited to this but the housing may be divided into an upper part and a lower part about the central portion.

Figure 6:
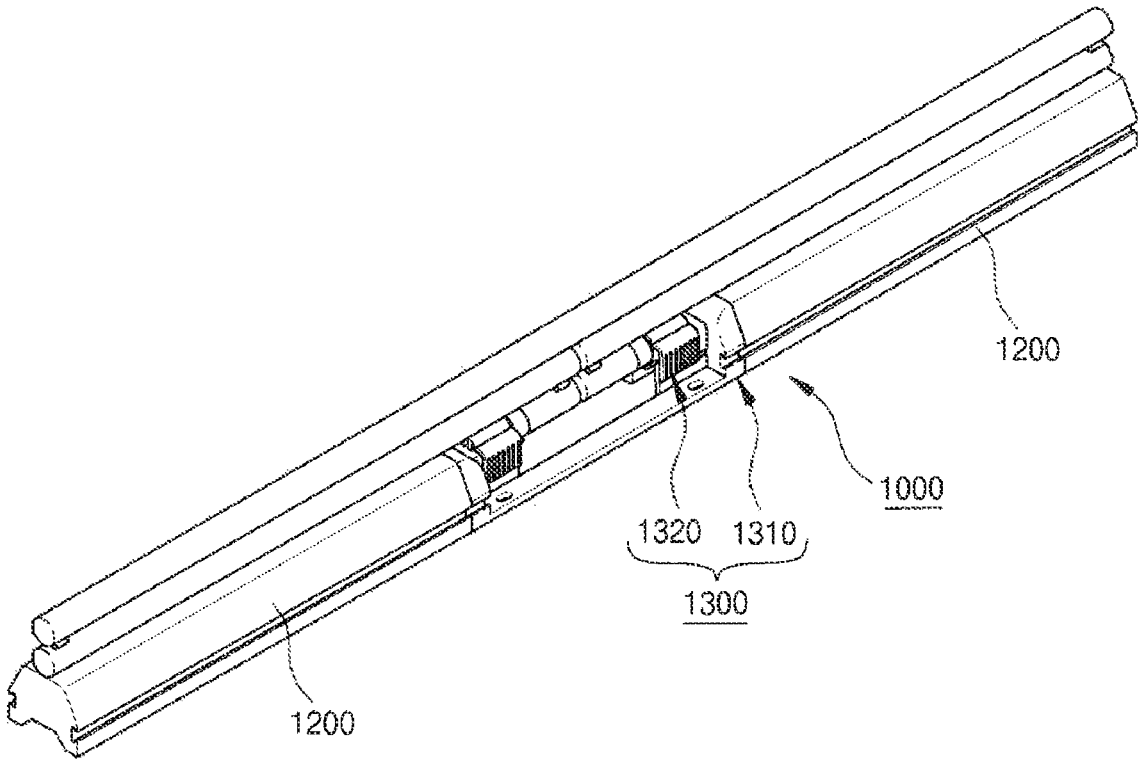
FIG. 6 is a perspective view illustrating a lamp socket according to still another embodiment of the present invention and a light appliance having the same.
Figure 7:
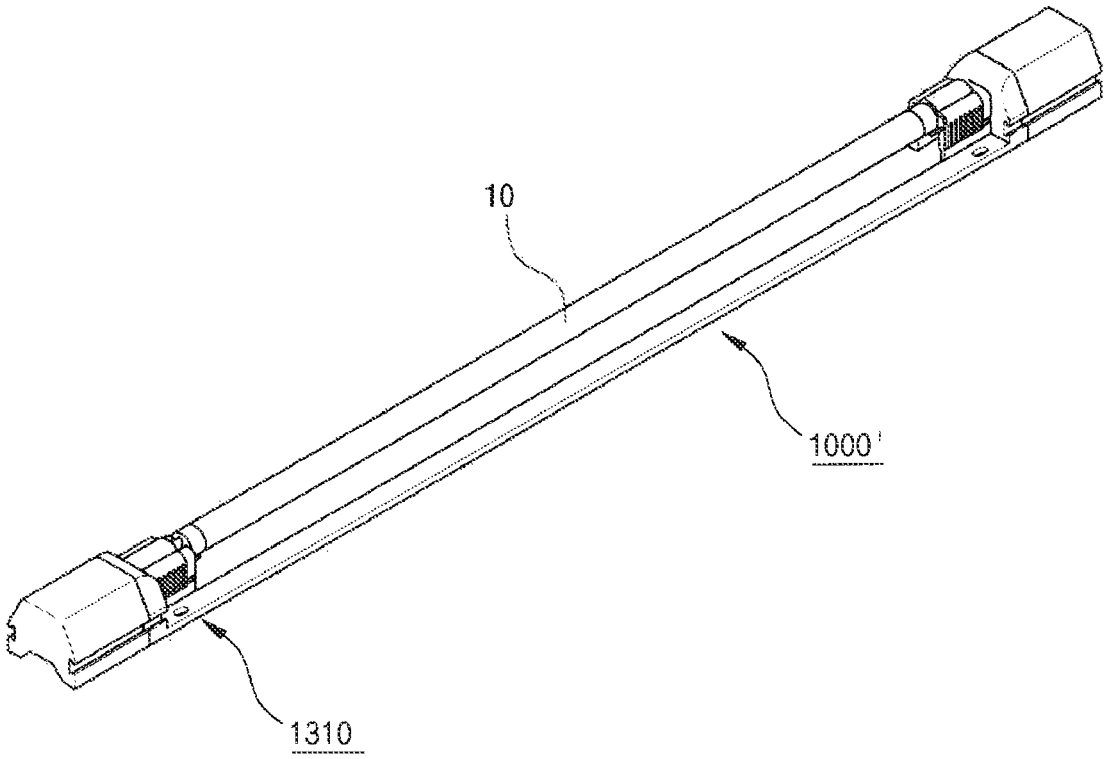
FIG. 7 is a perspective view illustrating a lamp socket according to still another embodiment of the present invention and a light appliance having the same.

On the other hand, FIGS. 6 and 7 are views illustrating a lamp socket according to still another embodiment of the present invention and a light appliance having the same.

In other words, as illustrated in FIG. 6, a light appliance 1000 is configured such that socket 1300, which respectively has connection terminal bodies 1310 provided to expose the connection terminals and connection caps 1320 provided to slide forward and backward in a predetermined direction on the connection terminal bodies 1310 to lock and release the connection pins of the lamp due to the sliding, are provided at lateral ends to face each other, and housings 1200 respectively provided to the connection terminal bodies 1310 of the socket 1300. Moreover, as illustrated in FIG. 7, a light appliance 1000' is configured such that socket 1310' is provided at side ends of the light appliance 1000' to be spaced apart from each other corresponding to positions of connection pins of a lamp 10' in the form of a single tube with the connection pins formed at lateral sides thereof. Since these configurations are identical except for the lamps provided at the positions of the socket, the detailed description thereof is omitted.

Mode for Invention

As such, when the light appliance having a lamp socket according to the embodiment of the present invention is installed to mount the lamp, as illustrated in FIGS. 1 to 3, and FIG. 5, the light appliance is fixed to a desired place where the lamp 10 is installed by fastening screws through the installation holes 317 formed in the lateral bottoms of the connection terminal body 310 of the socket 300.

In order to install the lamp 10 in the light appliance 100 fixed as described above to be turned on, the connection caps 320 are slid backward such that the connection terminals 20 are provided in the connection terminal recesses 314 formed in the upper sides of the connection units 313 of the socket 300.

As such, when the connection terminals 20 are exposed, the connection pins 11 of the lamp 10 are installed in the connection terminal recesses 314.

After that, when the connection caps 320 slide forward, the connection caps 320 slide along the guide recesses 315 formed in the lateral sides of the connection units 313 of the connection terminal body 310.

When the connection caps 320 slide, the connection protrusions 321 protruded from the lower sides of the connection caps 320 press the connection pins 11 of the lamp 10 connected to the upper sides of the connection terminals 20 elastically supported in the connection terminal recesses 314 by the elastic members 330.

Thus, the connection terminals 20 and the connection pins 11 are more securely connected to each other by the connection protrusions 321 and the elastic members 330 and the installation of the lamp 10 is completed.

Moreover, the ends of the lamp 10 are supported by the supporting protrusions 316 formed at sides of the connection units 313 of the connection terminal body 310 so that the lamp 10 can be more steadily installed.

As described above, the lamp can be conveniently and stably installed in correspondence to the sliding of the connection caps provided in the socket of the light appliances.

The invention claimed is:

1. A lamp socket provided in a housing of a light appliance to fix a lamp with connection pins, the lamp socket comprising:

connection terminals provided in one side of the socket to contact with the connection pins of the lamp;

a connection terminal body having connection terminal recesses into which the connection terminals are inserted;

connection caps for sliding to press and fix the connection pins so as to contact the connection pins with the connection terminals;

wherein the connection terminal body comprises guide recesses along which the connection caps slide, and the connection caps comprise guide protrusions inserted into the guide recesses; and wherein the connection caps comprise connection protrusions protruded from inner sides of the connection caps such that the connection protrusions press the connection pins when the connection caps slide.

2. The lamp socket according to claim 1, wherein an elastic member for increasing contacting force between the connection terminals and the connection pins is installed in the connection terminal recesses and the connection terminals are inserted into the upper sides of the elastic member.

3. The lamp socket according to claim 1, further comprising supporting protrusions protruded from side of the connection terminal bodies to support the lamp when the connection pins contact with the connection terminals.

4. The lamp socket according to claim 1, further comprising safety protrusions protruded from side of the connection caps to prevent an electric shock due to the connection pins when the connection pins of the lamp are coupled in the connection terminal recesses and safety engaging recesses formed in the central regions of the safety protrusions to allow the connection pins to penetrate therethrough.

5. The lamp socket according to claim 1, wherein each of the connection terminal bodies further comprises:

an insertion unit to be inserted into the housing; and a locking unit protruded over the insertion unit to be locked by the housing when the insertion unit is inserted into the housing;

wherein insides of the insertion unit and the locking unit are hollow such that electric wires for electrical connection of the connection terminals pass therethrough.

6. A light appliance to which a lamp is installed, comprising:

a housing as a case in which an electronic ballast and electronic components to drive the lamp are installed; and the lamp socket according to claim 1 connected to the housing.

7. The light appliance according to claim 6, wherein the pair of connection terminals of the lamp socket inwardly face each other or are outwardly spaced apart from each other corresponding to a direction where the lamp socket is coupled with the connection pins.

8. The light appliance according to claim 7, wherein each of the connection terminal bodies further comprises:

an insertion unit to be inserted into the housing; and a locking unit protruded over the insertion unit to be locked by the housing when the insertion unit is inserted into the housing;

wherein insides of the insertion unit and the locking unit are hollow such that electric wires for electrical connection of the connection terminals pass therethrough.

* * * * *